US010578380B2

(12) United States Patent
Jen

(10) Patent No.: US 10,578,380 B2
(45) Date of Patent: Mar. 3, 2020

(54) FIREARM RECEIVER PINS FOR QUICK DISASSEMBLY AND ASSEMBLY

(71) Applicant: Strike Industries, Inc., Santa Ana, CA (US)

(72) Inventor: Yi Huei Jen, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 48 days.

(21) Appl. No.: 15/859,722

(22) Filed: Jan. 1, 2018

(65) Prior Publication Data

US 2018/0187989 A1 Jul. 5, 2018

Related U.S. Application Data

(60) Provisional application No. 62/441,840, filed on Jan. 3, 2017.

(51) Int. Cl.
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
CPC .. F41A 11/04; F41A 11/00; F41A 3/36; F41A 3/66
See application file for complete search history.

(56) References Cited

U.S. PATENT DOCUMENTS

| | | | | |
|---|---|---|---|---|
| 7,937,876 | B1 * | 5/2011 | Graham | F41A 11/00 42/75.01 |
| 9,151,555 | B1 * | 10/2015 | Huang | F16B 15/02 |
| 9,389,031 | B2 * | 7/2016 | Gardner | F41A 3/66 |
| 10,018,436 | B1 * | 7/2018 | Cross | F41A 11/00 |
| 10,101,107 | B1 * | 10/2018 | Huang | F41A 3/66 |
| 2015/0308768 | A1 * | 10/2015 | Mills | F41A 11/04 42/75.03 |
| 2017/0016690 | A1 * | 1/2017 | Timmons | F41A 11/00 |
| 2017/0051546 | A1 * | 2/2017 | Seekins | F41A 11/00 |
| 2019/0072123 | A1 * | 3/2019 | Adams | F16B 19/02 |

* cited by examiner

*Primary Examiner* — Benjamin P Lee
(74) *Attorney, Agent, or Firm* — Andy M. Han; Han IP PLLC

(57) ABSTRACT

An apparatus implementable on a firearm may include a takedown pin and a pivot pin. The takedown pin holds together a rear portion of lower and upper receivers of the firearm. The pivot pin holds together a front portion of lower and upper receivers of the firearm. Each of the takedown pin and pivot pin respectively includes a head and a generally cylindrical shank extending from the head toward a distal end thereof opposite the head. The shank is configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

20 Claims, 4 Drawing Sheets

FIREARM RECEIVER PINS FOR QUICK DISASSEMBLY AND ASSEMBLY

CROSS REFERENCE TO RELATED PATENT APPLICATIONS

The present disclosure claims the priority benefit of, U.S. Provisional Patent Application No. 62/441,840, filed on 3 Jan. 2017, content of which is herein incorporated by reference in its entirety.

TECHNICAL FIELD

The present disclosure is generally related to firearms and, more particularly, to firearm receiver pins for quick disassembly and assembly.

BACKGROUND

Unless otherwise indicated herein, approaches described in this section are not prior art to the claims listed below and are not admitted as prior art by inclusion in this section.

Firearms such as AR15 rifles include an upper receiver and a lower receiver, which are typically engaged near a barrel location upon assembly with pivot and takedown pins. The pivot pin and takedown pin mainly provide the function of securing the upper and lower receivers together for normal use of the firearm. For purposes of maintenance such as cleaning, lubricating, or customizing parts of such a firearm, however, a user is typically required to disassemble the upper and lower receivers from each other by removing at least the takedown pin or both the takedown pin and pivot pin.

The pivot pin and the takedown pin need to be inserted into apertures in the upper and lower receivers of the firearm to assemble the lower receiver and upper receiver to each other. For the pivot pin, typically a corresponding detent pin needs to be inserted inside a chamber of the lower receiver, wherein the pivot pin depresses an associated spring underneath the detent pin as the pivot pin laterally slides into a pivot pin aperture on the lower receiver. For the takedown pin, the takedown pin is typically inserted into a takedown pin aperture first. Then, a corresponding detent pin and an associated spring are inserted inside another chamber of the lower receiver, whereby an end plate (or a receiver) depresses the spring and the detent pin as a castle nut tightens the end plate onto a buffer tube of the firearm. However, for both pivot pin and takedown pin, assembly and disassembly tend to be difficult for a user due to the opposing force that each spring associated with the pivot pin and takedown pin exerts. This is due to the protruding force exerted by the spring often impedes assembly and disassembly processes and causes problems for many users such as losing springs or pins if such small parts are not properly aligned.

Moreover, traditionally, many users follow tedious steps and require special tools such as Clevis pins in order to handle pins during assembly and disassembly of the upper receiver and the lower receiver of a firearm. Even with fancy tools that are solely dedicated to deal with the pivot and takedown pins, it is still tedious and time consuming for the user. Besides, traditional pivot and takedown pins have a single track where all three small parts of the spring, the detent pin, and either the pivot pin or the takedown pin need to be carefully guided and aligned simultaneously at one point during assembly and disassembly. Otherwise, inconvenience and frustration may result (e.g., the detent pin could take into the air due to spring compression).

There are pins that simplify disassembly and assembly processes using a magnet, but such pins in the market still do not solve issues such as inconvenience in disassembly that requires a tool to depress the detent pin each time. With existing and current configurations of pivot pins and takedown pins, it tends to be difficult for a user to switch the pins from a locking position to a release position easily and quickly in order to separate the upper and lower receivers that are joined together by the pivot pin and takedown pin.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

The present disclosure proposes improved designs and configurations under which the pivot pin and takedown pin can be easily installed and removed to allow assembly and disassembly of upper and lower receivers of a AR15-styled firearm without a hassle. The improved design and configuration of the pivot pin and the takedown pin enable a user to easily and quickly assemble and disassemble upper and lower receivers without a special tool.

In one aspect, an apparatus implementable on a firearm may include a takedown pin configured to hold together a rear portion of a lower receiver of the firearm and a rear portion of an upper receiver of the firearm. The takedown pin may include a head and a generally cylindrical shank extending from the head toward a distal end of the takedown pin opposite the head. The shank may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

In one aspect, an apparatus implementable on a firearm may include a pivot pin configured to hold together a front portion of a lower receiver of the firearm and a front portion of an upper receiver of the firearm. The pivot pin may include a head and a generally cylindrical shank extending from the head toward a distal end of the pivot pin opposite the head. The shank may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

In one aspect, an apparatus implementable on a firearm may include a takedown pin and a pivot pin. The takedown pin may be configured to hold together a rear portion of a lower receiver of the firearm and a rear portion of an upper receiver of the firearm. The pivot pin may be configured to hold together a front portion of the lower receiver of the firearm and a front portion of the upper receiver of the firearm. Each of the takedown pin and the pivot pin may respectively include a head and a generally cylindrical shank extending from the head toward a distal end of the pin opposite the head. The shank may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

It is noteworthy that, although examples provided in the present disclosure may be related to a certain type of firearms (e.g., AR15), various embodiments in accordance with the present disclosure may be adapted or otherwise implemented in different types of firearms. For instance, various embodiments in accordance with the present disclosure may be utilized with semiautomatic pistols, semiautomatic rifles, semiautomatic carbines, bolt-action rifles, as well as other types of firearms. Therefore, the scope of the present disclosure is not limited to examples provided herein.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Figure 1A:
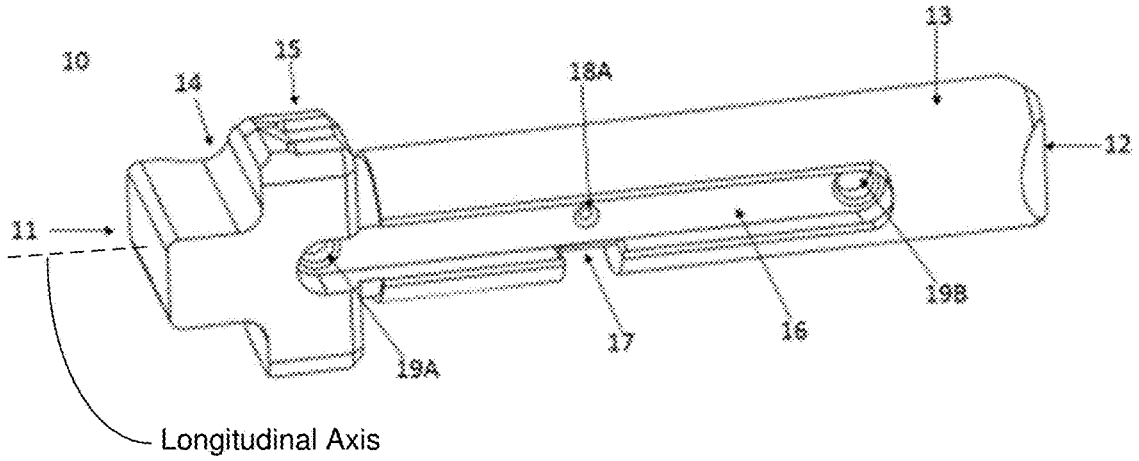
FIG. 1A is a perspective view of one side of a pivot pin in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

The terminology used herein is for the purpose of describing particular embodiments and is not intended to be limiting of the scope of the present disclosure. Unless otherwise defined, all terms used herein have the same meaning as commonly understood by one having ordinary skill in the art to which the present disclosure belongs. The present disclosure is to be considered as an exemplification of various designs and configurations in accordance with the present disclosure, and is not intended to limit the scope of the present disclosure to the specific embodiments illustrated by the figures or description below.

Overview

As used herein, "pivot pin" and "takedown pin" refer to the pin or pins which support opening and closing of an upper receiver of a firearm to a lower receiver of the firearm. The pivot pin typically secures and holds a front portion of the upper and lower receivers toward a barrel of the firearm and allows the upper receiver to pivot without being separated from the lower receiver. The takedown pin typically secures and holds a rear portion of the upper and lower receivers toward a stock or buffer tube of the firearm.

Traditional pivot pins and takedown pins typically have a single groove track, and the installation and operation of traditional pivot pins and takedown pins typically involve three small parts, namely: a detent pin, a detent pin spring, and the pivot pin/takedown pin itself. Thus, the installation of a traditional pivot pin/takedown pin onto a lower receiver of a firearm (e.g., AR15-styled firearm) generally requires the detent pin and the single groove track of the pivot pin/takedown pin to be aligned at a certain point until they are in a locking position.

Under the proposed design and configuration of the present disclosure, each of a pivot pin and a takedown pin may be configured with an innovative "shifting" feature. Specifically, each of the pivot pin and takedown pin in accordance with the present disclosure may include the following groove tracks: (1) a first groove track (hereinafter interchangeably referred as the "traditional track") extending along a longitudinal axis of a generally cylindrical shank of the pivot pin/takedown pin, (2) a second groove track (hereinafter interchangeably referred as the "shift track") which is parallel to the first groove track and extending along the longitudinal axis of the shank, and (3) a linking groove track extending around the longitudinal axis of the shank and linking the first groove track and the second groove track. An angle between the first groove track and the second groove track may be up to 180° (e.g., 45°, 60°, 90°, 135° or 180°). For instance, the angle may be 180° and thus the second groove track may be on a side of the shank opposite to another side where the first groove track is located.

Illustrative Implementations

Figure 1B:
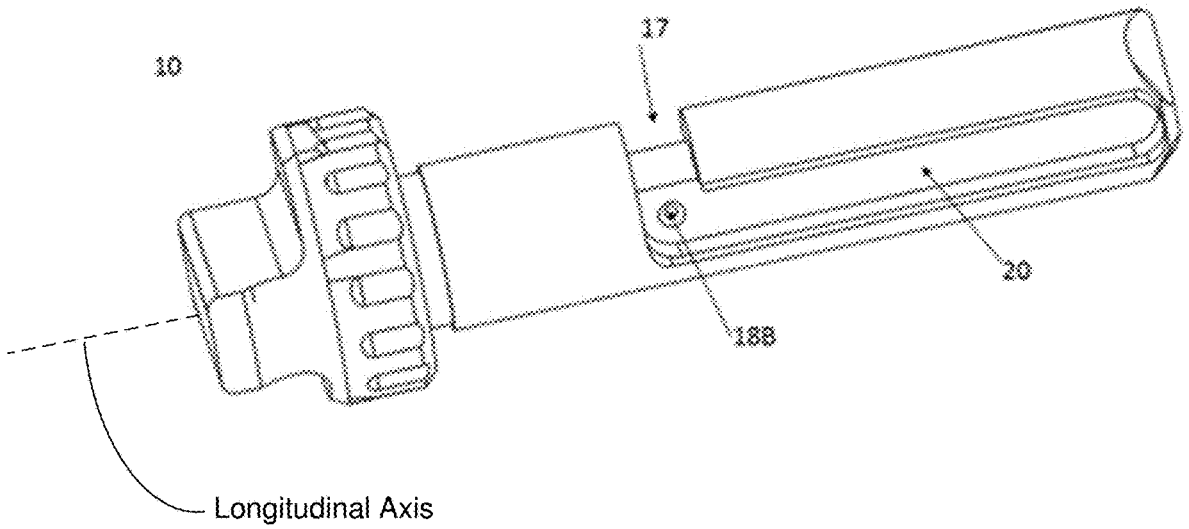
FIG. 1B is a perspective view of another side of a pivot pin in accordance with an implementation of the present disclosure.
Figure 2A:
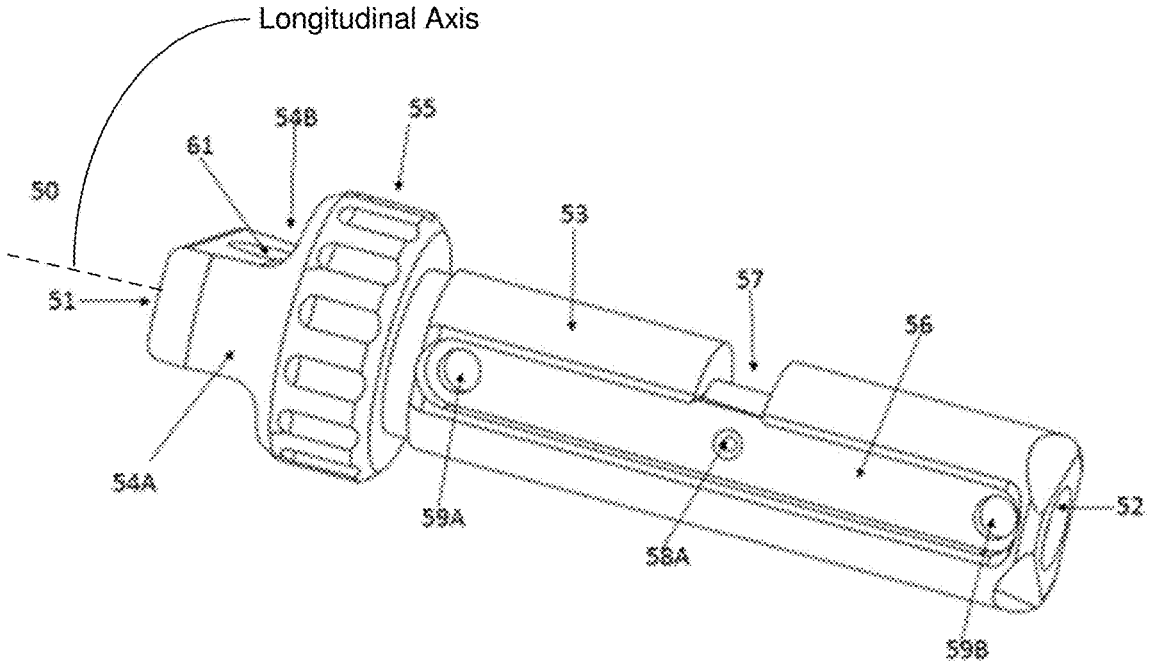
FIG. 2A is a perspective view of one side of a takedown pin in accordance with an implementation of the present disclosure.
Figure 2B:
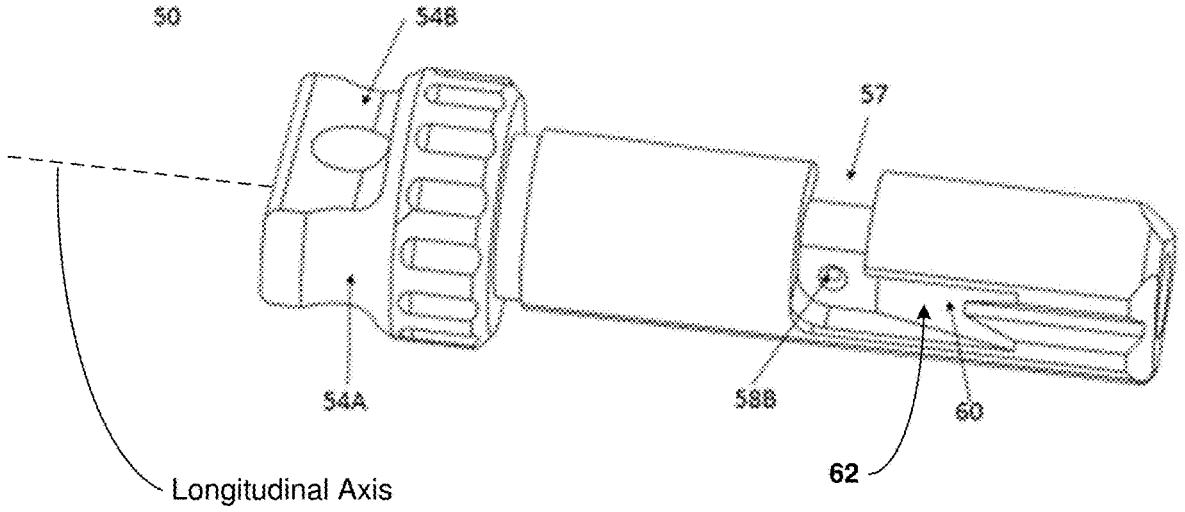
FIG. 2B is perspective view of another side of a takedown pin in accordance with an implementation of the present disclosure.

FIG. 1A and FIG. 1B illustrate a pivot pin 10 in accordance with an implementation of the present disclosure. FIG. 2A and FIG. 2B illustrate a takedown pin 50 in accordance with an implementation of the present disclosure. Description of pivot pin 10 and takedown pin 50 is provided below with reference to FIG. 1A-FIG. 2B.

Referring to FIG. 1A and FIG. 1B, pivot pin 10 may include a head 11 and a generally cylindrical shank 13 extending from the head 11 toward a distal end 12 of the pivot pin 10 opposite the head 11. The shank 13 may be configured with: (1) a first groove track 16 extending along a longitudinal axis of the shank 13, (2) a second groove track 20 parallel to the first groove track 16 and extending along the longitudinal axis of the shank 13, and (3) a linking groove track 17 extending around the longitudinal axis of the shank 13 and linking the first groove track 16 and the second groove track 20.

In some implementations, the first groove track 16, the second groove track 20 and the linking groove track 17 may be configured to receive a tip portion of a detent pin (not shown) of the firearm. When the tip portion of the detent pin is received in the first groove track 16, the first groove track 16 may limit the pivot pin 10 to move linearly along the longitudinal axis of the pivot pin 10. When the tip portion of the detent pin is received in the linking groove track 17, the linking groove track 17 may limit the pivot pin 10 to rotate partially around the longitudinal axis of the pivot pin 10 to allow the tip portion of the detent pin to move along the linking groove track 17 between the first groove track 16 and the second groove track 20. When the tip portion of the detent pin is received in the second groove track 20, the second groove track 20 may limit the pivot pin 10 to move linearly along the longitudinal axis of the pivot pin 10.

In some implementations, two distal ends of the first groove track 16 may be close-ended such that, when the tip portion of the detent pin is received in the first groove track 16, the detent pint prevents removal of the pivot pin 10 from the firearm. The linking groove track 17 may connect to a middle portion of the first groove track 16 between the two distal ends of the first groove track 16 such that, when the tip portion of the detent pin moves from the linking groove track 17 to the first groove track 16, the tip portion of the detent pin is allowed to move between the two distal ends of the first groove track 16 by linear motions of the pivot pin 10. The second groove track 20 may extend between the linking groove track 17 and the distal end of the pivot pin 10. A first distal end of the second groove track 20 may connect with the linking groove track 17. A second distal end of the second groove track 20 opposite the first distal end may be close-ended such that, when the tip portion of the detent pin is received in the second groove track 20, the pivot pin 10 is removable from the firearm by a linear movement of the pivot pin 10 with the tip portion of the detent pin sliding to the second distal end of the second groove track 20.

In some implementations, the shank 13 may also include a first recess 18A and a second recess 18B. The first recess 18A may be at an intersection between the first groove track 16 and the linking groove track 17. The second recess 18B may be at an intersection between the second groove track 20 and the linking groove track 17. The first recess 18A and the second recess 18B may permit the pivot pin 10 to click and stop when the pivot pin 10 is rotated to allow the tip portion of the detent pin to move in the linking groove track 17 from the first groove track 16 to the second groove track 20 or from the second groove track 20 to the first groove track 16.

In some implementations, the shank 13 may further include a third recess 19A and a fourth recess 19B. The third recess 19A may be at one of the two distal ends of the first groove track 16. The fourth recess 19B may be at another of the two distal ends of the first groove track 16. The third recess 19A and the fourth recess 19B may permit the pivot pin 10 to click and stop when the pivot pin 10 is moved linearly to allow the tip portion of the detent pin to move in the first groove track 16 between the two distal ends of the first groove track 16.

Referring to FIG. 2A and FIG. 2B, takedown pin 50 may include a head 51 and a generally cylindrical shank 53 extending from the head 51 toward a distal end 52 of the takedown pin 50 opposite the head 51. The shank 53 may be configured with: (1) a first groove track 56 extending along a longitudinal axis of the shank 53, (2) a second groove track 60 parallel to the first groove track 56 and extending along the longitudinal axis of the shank 53, and (3) a linking groove track 57 extending around the longitudinal axis of the shank 53 and linking the first groove track 56 and the second groove track 60.

In some implementations, the first groove track 56, the second groove track 57 and the linking groove track 60 may be configured to receive a tip portion of a detent pin (not shown) of the firearm. When the tip portion of the detent pin is received in the first groove track 56, the first groove track 56 may limit the takedown pin 50 to move linearly along the longitudinal axis of the takedown pin 50. When the tip portion of the detent pin is received in the linking groove track 57, the linking groove track 57 may limit the takedown pin 50 to rotate partially around the longitudinal axis of the takedown pin 50 to allow the tip portion of the detent pin to move along the linking groove track 57 between the first groove track 56 and the second groove track 60. When the tip portion of the detent pin is received in the second groove track 60, the second groove track 60 may limit the takedown pin 50 to move linearly along the longitudinal axis of the takedown pin 50.

In some implementations, two distal ends of the first groove track 56 may be close-ended such that, when the tip portion of the detent pin is received in the first groove track 56, the detent pint prevents removal of the takedown pin 50 from the firearm. The linking groove track 57 may connect to a middle portion of the first groove track 56 between the two distal ends of the first groove track 56 such that, when the tip portion of the detent pin moves from the linking groove track 57 to the first groove track 56, the tip portion of the detent pin is allowed to move between the two distal ends of the first groove track 56 by linear motions of the takedown pin 10. The second groove track 60 may extend between the linking groove track 57 and the distal end of the takedown pin 50. A first distal end of the second groove track 60 may connect with the linking groove track 57. A second distal end of the second groove track 60 opposite the first distal end may be open-ended such that, when the tip portion of the detent pin is received in the second groove track 60, the takedown pin 50 is removable from the firearm by a linear movement of the takedown pin 50 with the tip portion of the detent pin sliding out of the second distal end of the second groove track 60.

In some implementations, at least a portion of a bottom surface of the second groove track 60 may include a slope 62 such that a depth of a first end of the slope 62 toward the first distal end of the second groove track 60 is greater than a depth of a second end of the slope 62 toward the second distal end of the second groove track 60.

In some implementations, the shank 53 may also include a first recess 58A and a second recess 58B. The first recess 58A may be at an intersection between the first groove track 56 and the linking groove track 57. The second recess 58B may be at an intersection between the second groove track 60 and the linking groove track 57. The first recess 58A and the second recess 58B may permit the takedown pin 50 to click and stop when the takedown pin 50 is rotated to allow the tip portion of the detent pin to move in the linking groove track 57 from the first groove track 56 to the second groove track 60 or from the second groove track 60 to the first groove track 56.

In some implementations, the shank 53 may further include a third recess 59A and a fourth recess 59B. The third recess 59A may be at one of the two distal ends of the first groove track 56. The fourth recess 59B may be at another of the two distal ends of the first groove track 56. The third recess 59A and the fourth recess 59B may permit the takedown pin 50 to click and stop when the takedown pin 50 is moved linearly to allow the tip portion of the detent pin to move in the first groove track 56 between the two distal ends of the first groove track 56.

Figure 3:
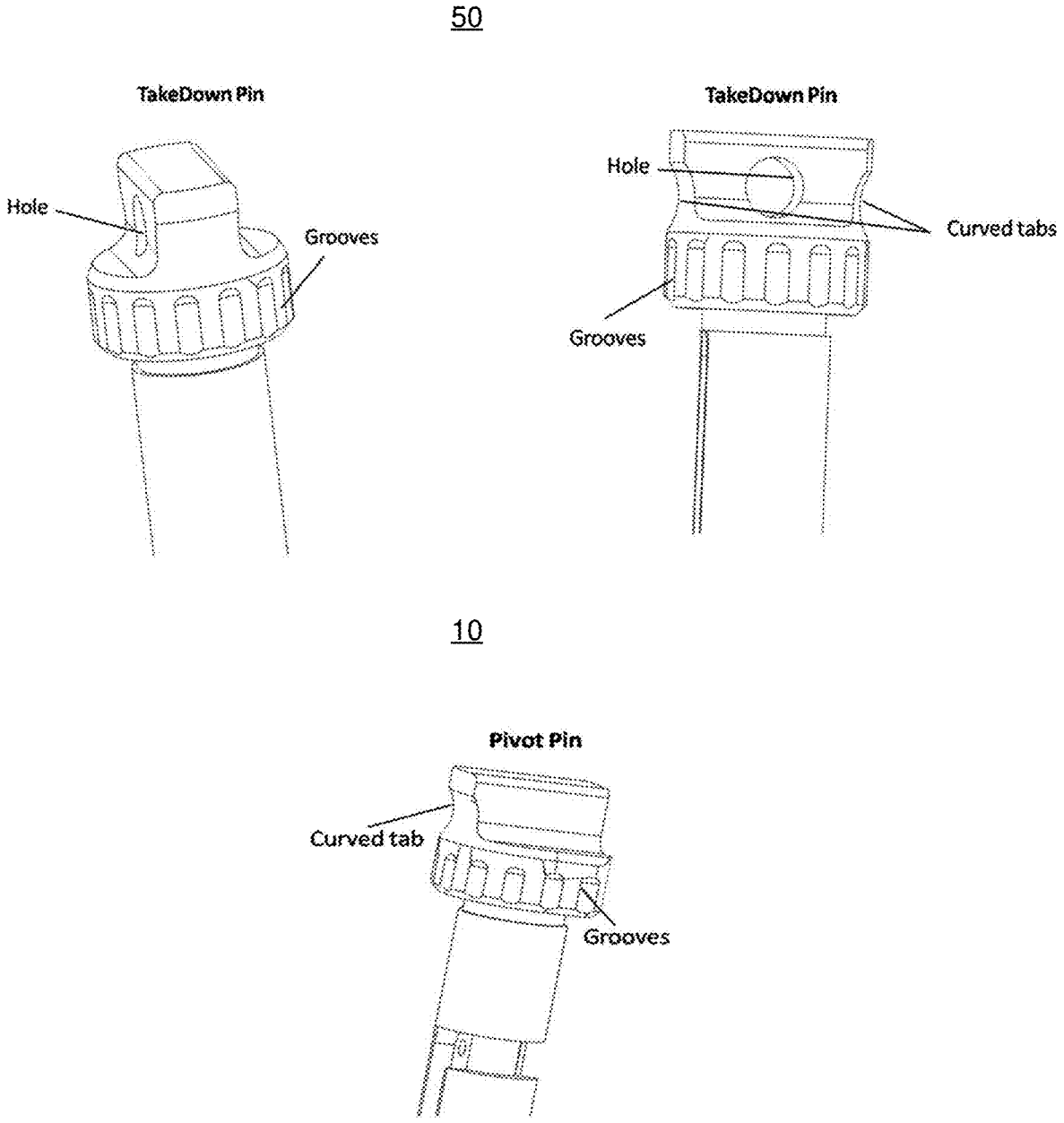
FIG. 3 is a diagram of additional features of a takedown pin and a pivot pin in accordance with an implementation of the present disclosure.

FIG. 3 illustrates additional features of takedown pin 50 and pivot pin 10 in accordance with an implementation of the present disclosure. Referring to FIG. 3, a circumference of the head 51 of the takedown pin 50 may include textures, which may include a plurality of grooves around the circumference, dots, diagonal lines, golf ball patterns, hexagonal patterns, non-smooth patterns, or a combination thereof. Also, referring to FIG. 3, a circumference of the head 11 of the pivot pin 10 may include textures, which may include a plurality of grooves around the circumference, dots, diagonal lines, golf ball patterns, hexagonal patterns, non-smooth patterns, or a combination thereof.

In some implementations, the head 51 of takedown pin 50 may include two tabs 54A and 54B around the head 51. Tabs 54A and 54B may be configured in various designs such as curved or angled to allow easy handling so that a user can hold, rip, turn, shift or pull takedown pin 50 easily. In some implementations, the head 11 of pivot pin 10 may include a tab 14 protruding from the head 11. Tab 14 may be configured in various designs such as curved or angled to allow easy handling so that a user can hold, rip, turn, shift or pull pivot pin 10 easily.

In some implementations, for functional and cosmetic reasons, it is understood that design of the head 51 of takedown pin 50 and the head 11 of pivot pin 10 may have various shapes such as triangle, circle, oval, half circle or any other polygon shapes as well as textures such as dots, diagonal lines, golf ball patterns, hexagonal patterns, any texture that is not smooth, or any combination thereof.

In some implementations, each of takedown pin 50 and pivot pin 10 may also include a hole (e.g., hole 61 on takedown pin 50 as shown in FIG. 2A and FIG. 2B) on the head 51 or 11. The hole may permit a user to loop a cord or a key ring so as to access the pin easily by pulling the object attached to the hole.

In some implementations, pivot pin 10 and takedown pin 50 may incorporate grooves 15 and grooves 55 around the circumference of head 11 and head 51, respectively, to guide motion at ease. The groove designs may vary such as round, angular or other desired profiles. The grooves 15 and 55 may allow a user to hold the pivot pin 10 and takedown pin 50 easily for turning.

In some implementations, pivot pin 10 and takedown pin 50 may be made of steel. Alternative materials having similar properties of steel may be contemplated to construct pivot pin 10 and takedown pin 50 as well.

Figure 4:
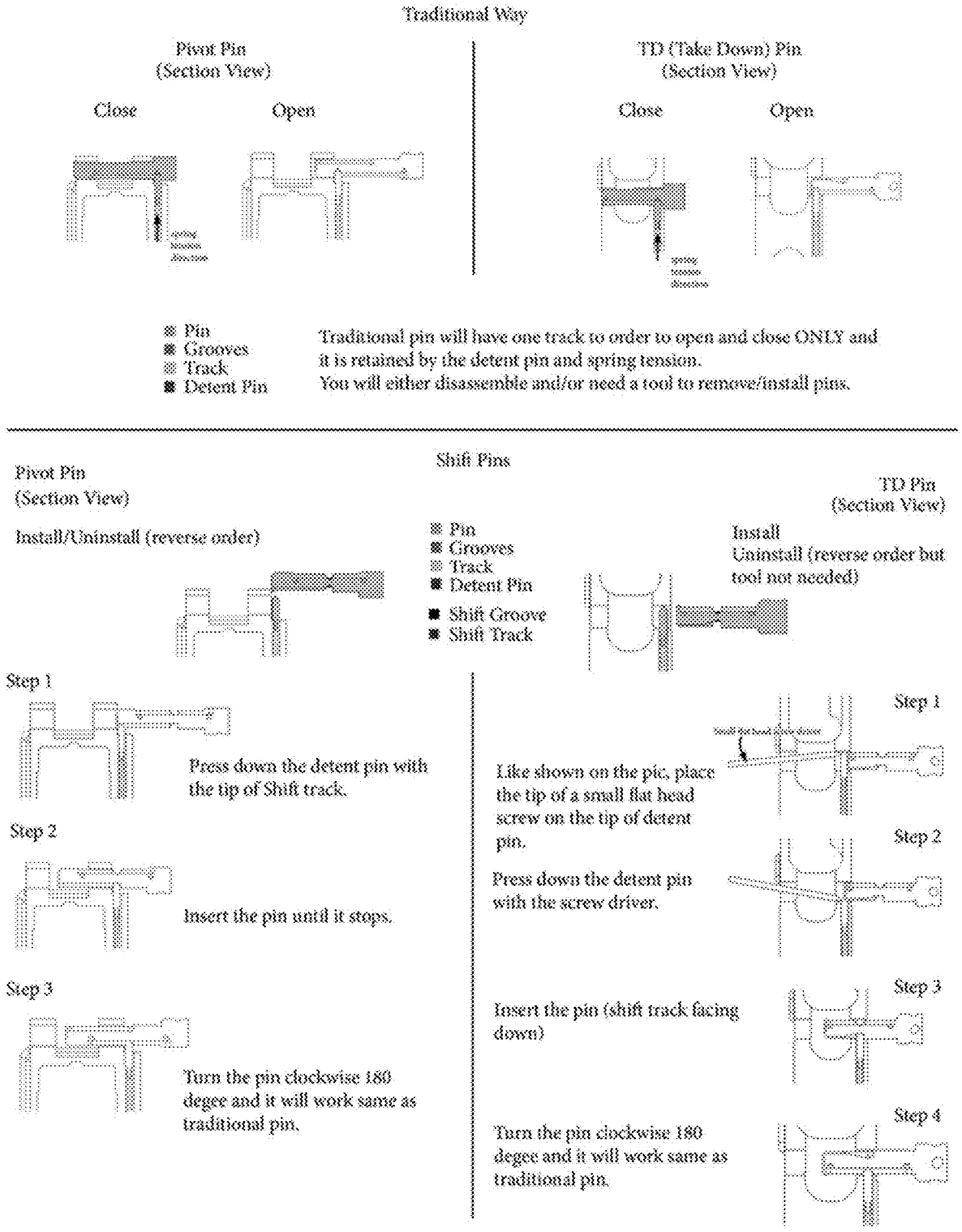
FIG. 4 is a diagram of a method of using a pivot pin and a takedown pin in accordance with an implementation of the present disclosure.

FIG. 4 is a diagram of a method of using pivot pin 10 and takedown pin 50 in accordance with an implementation of the present disclosure.

In operation, the first recess 18A/58B and second recess 18B/58B may allow a detent pin to stop and travel along the linking groove track 17/57 that may guide a rotational force to change or shift the track in use from the traditional track (first groove track 16/56) to the shift track (second groove track 20/60), or vice versa. Hence, the shifting feature may eliminate a need of special tools other than a simple flat-headed pin such as a screw for assembly of the takeout pin 50, as well as the step requiring a user to manually align the three parts of the detent pin spring, the detent pin, and the takedown pin.

For assembly of the pivot pin 10, referring to FIG. 4, starting from the tip of the shift track (second groove track 20) near the distal end 12 of pivot pin 10, a detent pin may be pressed down along the shift track (second groove track 20) until the pivot pin 10 clicks and stops at the second recess 18B inside the shift track (second groove track 20). Next, with a rotational force applied at the pivot pin 10, the linking groove track 17 guides the pivot pin 10 to turn, and the detent pin clicks and stops at the second recess 18A on the traditional track (first groove track 16). Then, the detent pin touching the traditional track (first groove track 16) may settle at the locking position as how a traditional pin works. For disassembly of the pivot pin 10, referring to FIG. 4, the pivot pin 10 may be rotated along the linking groove track 17 until the detent pin clicks and stops at the second recess 18B on the shift track (second groove track 20), and the pivot pin 10 may be pulled out along the shift track (second groove track 20). The third recess 19A and fourth recess 19B may provide the detent pin a transition to the traditional track (first groove track 16) while pressing down the detent pin. The third recess 19A and fourth recess 19B on the traditional track (first groove track 16) may help the pivot pin 10 to work the same as in traditional way.

For assembly of the takedown pin 50, the takedown pin 50 may be inserted into a takedown pin aperture first as its shift track (second groove track 60) faces where the detent pin is to be placed. Then, the detent pin and the detent pin spring may be inserted in order inside a chamber of the lower receiver, which may require a common tool such as a small flat-head screw to handle the spring exert opposing force. Upon the arrangement of the takedown pin, 50 the detent pin and the detent pin spring, referring to FIG. 4, the takedown pin 50 may click and stop at the second recess 58B along the shift track (second groove track 60). Next, the takedown pin 50 may be rotated along the linking groove track 57 until the detent pin clicks and stops again at the first recess 58). Thereafter, the takedown pin 50 may work the same way as how a traditional pin works. For disassembly of the takedown pin 50, referring to FIG. 4, the takedown pin 50 may be rotated along the linking groove track 57 until the detent pin clicks and stops at the second recess 58B on the shift track (second groove track 60), and the takedown pin 50 may be pulled out along the shift track (second groove track 60).

In some implementations, the shift track (second grove track 60) of the takedown pin 50 may be beveled to prevent the takedown pin 50 from rotating in a wrong direction and guide the rotation in one way, which make the installation easy. The shift track (second groove track 60) may provide the detent pin a transition to the traditional track (first groove track 56) while pressing down the detent pin. The linking groove track 57 may guide the application of a rotational force until the detent pin changes the track, from the traditional track (first groove track 56) to the shift track (second groove track 60), or vice versa. The first recess 58A and second recess 58B may permit the takedown pin 50 to click and stop where the track switches from the shift track (second groove track 60) to the traditional track (first groove track 56), or vice versa. The third recess 59A and fourth recess 59B on the traditional track (first groove track 56) may help the takedown pin 50 to work the same as in the traditional way.

Highlight of Select Features

In view of the above, a number of features of a takedown pin and a pivot pin in accordance with the present disclosure are highlighted below.

In one aspect, an apparatus implementable on a firearm may include a takedown pin configured to hold together a rear portion of a lower receiver of the firearm and a rear portion of an upper receiver of the firearm. The takedown pin may include a head and a generally cylindrical shank extending from the head toward a distal end of the takedown pin opposite the head. The shank may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

In some implementations, the first groove track, the second groove track and the linking groove track may be configured to receive a tip portion of a detent pin of the firearm. When the tip portion of the detent pin is received in the first groove track, the first groove track may limit the takedown pin to move linearly along the longitudinal axis of the takedown pin. When the tip portion of the detent pin is received in the linking groove track, the linking groove track may limit the takedown pin to rotate partially around the longitudinal axis of the takedown pin to allow the tip portion of the detent pin to move along the linking groove track between the first groove track and the second groove track. When the tip portion of the detent pin is received in the second groove track, the second groove track may limit the takedown pin to move linearly along the longitudinal axis of the takedown pin.

In some implementations, two distal ends of the first groove track may be close-ended such that, when the tip portion of the detent pin is received in the first groove track, the detent pint prevents removal of the takedown pin from the firearm. The linking groove track may connect to a middle portion of the first groove track between the two distal ends of the first groove track such that, when the tip portion of the detent pin moves from the linking groove track to the first groove track, the tip portion of the detent pin is allowed to move between the two distal ends of the first groove track by linear motions of the takedown pin. The second groove track may extend between the linking groove track and the distal end of the takedown pin. A first distal end of the second groove track may connect with the linking groove track. A second distal end of the second groove track opposite the first distal end may be open-ended such that, when the tip portion of the detent pin is received in the second groove track, the takedown pin is removable from the firearm by a linear movement of the takedown pin with the tip portion of the detent pin sliding out of the second distal end of the second groove track.

In some implementations, at least a portion of a bottom surface of the second groove track may include a slope such that a depth of a first end of the slope toward the first distal end of the second groove track is greater than a depth of a second end of the slope toward the second distal end of the second groove track.

In some implementations, the shank may also include a first recess and a second recess. The first recess may be at an intersection between the first groove track and the linking groove track. The second recess may be at an intersection between the second groove track and the linking groove track. The first recess and the second recess may permit the takedown pin to click and stop when the takedown pin is rotated to allow the tip portion of the detent pin to move in the linking groove track from the first groove track to the second groove track or from the second groove track to the first groove track.

In some implementations, the shank may further include a third recess and a fourth recess. The third recess may be at one of the two distal ends of the first groove track. The fourth recess may be at another of the two distal ends of the first groove track. The first recess and the second recess may permit the takedown pin to click and stop when the takedown pin is moved linearly to allow the tip portion of the detent pin to move in the first groove track between the two distal ends of the first groove track.

In some implementations, a circumference of the head of the takedown pin may include textures, which may include a plurality of grooves around the circumference, dots, diagonal lines, golf ball patterns, hexagonal patterns, non-smooth patterns, or a combination thereof.

In one aspect, an apparatus implementable on a firearm may include a pivot pin configured to hold together a front portion of a lower receiver of the firearm and a front portion of an upper receiver of the firearm. The pivot pin may include a head and a generally cylindrical shank extending from the head toward a distal end of the pivot pin opposite the head. The shank may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

In some implementations, the first groove track, the second groove track and the linking groove track may be configured to receive a tip portion of a detent pin of the firearm. When the tip portion of the detent pin is received in the first groove track, the first groove track may limit the pivot pin to move linearly along the longitudinal axis of the pivot pin. When the tip portion of the detent pin is received in the linking groove track, the linking groove track may limit the pivot pin to rotate partially around the longitudinal axis of the pivot pin to allow the tip portion of the detent pin to move along the linking groove track between the first groove track and the second groove track. When the tip portion of the detent pin is received in the second groove track, the second groove track may limit the pivot pin to move linearly along the longitudinal axis of the pivot pin.

In some implementations, two distal ends of the first groove track may be close-ended such that, when the tip portion of the detent pin is received in the first groove track, the detent pint prevents removal of the pivot pin from the firearm. The linking groove track may connect to a middle portion of the first groove track between the two distal ends of the first groove track such that, when the tip portion of the detent pin moves from the linking groove track to the first groove track, the tip portion of the detent pin is allowed to move between the two distal ends of the first groove track by linear motions of the pivot pin. The second groove track may extend between the linking groove track and the distal end of the pivot pin. A first distal end of the second groove track may connect with the linking groove track. A second distal end of the second groove track opposite the first distal end may be close-ended such that, when the tip portion of the detent pin is received in the second groove track, the pivot pin is removable from the firearm by a linear movement of the pivot pin with the tip portion of the detent pin sliding to the second distal end of the second groove track.

In some implementations, the shank may also include a first recess and a second recess. The first recess may be at an intersection between the first groove track and the linking groove track. The second recess may be at an intersection between the second groove track and the linking groove track. The first recess and the second recess may permit the pivot pin to click and stop when the pivot pin is rotated to allow the tip portion of the detent pin to move in the linking groove track from the first groove track to the second groove track or from the second groove track to the first groove track.

In some implementations, the shank may further include a third recess and a fourth recess. The third recess may be at one of the two distal ends of the first groove track. The fourth recess may be at another of the two distal ends of the first groove track. The third recess and the fourth recess may permit the pivot pin to click and stop when the pivot pin is moved linearly to allow the tip portion of the detent pin to move in the first groove track between the two distal ends of the first groove track.

In some implementations, a circumference of the head of the pivot pin may include textures, which may include a plurality of grooves around the circumference, dots, diagonal lines, golf ball patterns, hexagonal patterns, non-smooth patterns, or a combination thereof.

An apparatus implementable on a firearm may include a takedown pin and a pivot pin. The takedown pin may be configured to hold together a rear portion of a lower receiver of the firearm and a rear portion of an upper receiver of the firearm. The pivot pin may be configured to hold together a front portion of the lower receiver of the firearm and a front portion of the upper receiver of the firearm. Each of the takedown pin and the pivot pin may respectively include a head and a generally cylindrical shank extending from the head toward a distal end of the takedown pin/pivot pin opposite the head. The shank of each of the takedown pin and the pivot pin may be configured with: (1) a first groove track extending along a longitudinal axis of the shank, (2) a second groove track parallel to the first groove track and extending along the longitudinal axis of the shank, and (3) a linking groove track extending around the longitudinal axis of the shank and linking the first groove track and the second groove track.

In some implementations, the first groove track, the second groove track and the linking groove track of the takedown pin may be configured to receive a tip portion of a first detent pin of the firearm. When the tip portion of the first detent pin is received in the first groove track of the takedown pin, the first groove track of the takedown pin may limit the takedown pin to move linearly along the longitudinal axis of the takedown pin. When the tip portion of the first detent pin is received in the linking groove track of the takedown pin, the linking groove track of the takedown pin may limit the takedown pin to rotate partially around the longitudinal axis of the takedown pin to allow the tip portion of the first detent pin to move along the linking groove track between the first groove track and the second groove track. When the tip portion of the first detent pin is received in the second groove track of the takedown pin, the second groove track of the takedown pin may limit the takedown pin to move linearly along the longitudinal axis of the takedown pin.

In some implementations, two distal ends of the first groove track of the takedown pin may be close-ended such that, when the tip portion of the first detent pin is received in the first groove track of the takedown pin, the first detent pint prevents removal of the takedown pin from the firearm. The linking groove track of the takedown pin may connect to a middle portion of the first groove track of the takedown pin between the two distal ends of the first groove track such that, when the tip portion of the first detent pin moves from the linking groove track to the first groove track, the tip portion of the first detent pin is allowed to move between the two distal ends of the first groove track by linear motions of the takedown pin. The second groove track of the takedown pin may extend between the linking groove track of the takedown pin and the distal end of the takedown pin. A first distal end of the second groove track of the takedown pin may connect with the linking groove track of the takedown pin. A second distal end of the second groove track of the takedown pin opposite the first distal end may be open-ended such that, when the tip portion of the first detent pin is received in the second groove track of the takedown pin, the takedown pin is removable from the firearm by a linear movement of the takedown pin with the tip portion of the first detent pin sliding out of the second distal end of the second groove track of the takedown pin.

In some implementations, at least a portion of a bottom surface of the second groove track of the takedown pin may include a slope such that a depth of a first end of the slope toward the first distal end of the second groove track of the takedown pin is greater than a depth of a second end of the slope toward the second distal end of the second groove track of the takedown pin.

In some implementations, the shank of the takedown pin may also include a first recess and a second recess. The first recess may be at an intersection between the first groove track and the linking groove track. The second recess may be at an intersection between the second groove track and the linking groove track. The first recess and the second recess may permit the takedown pin to click and stop when the takedown pin is rotated to allow the tip portion of the first detent pin to move in the linking groove track from the first groove track to the second groove track or from the second groove track to the first groove track.

In some implementations, the first groove track, the second groove track and the linking groove track of the pivot pin may be configured to receive a tip portion of a second detent pin of the firearm. When the tip portion of the second detent pin is received in the first groove track of the pivot pin, the first groove track of the pivot pin may limit the pivot pin to move linearly along the longitudinal axis of the pivot pin. When the tip portion of the second detent pin is received in the linking groove track of the pivot pin, the linking groove track of the pivot pin may limit the pivot pin to rotate partially around the longitudinal axis of the pivot pin to allow the tip portion of the second detent pin to move along the linking groove track between the first groove track of the pivot pin and the second groove track of the pivot pin. When the tip portion of the second detent pin is received in the second groove track of the pivot pin, the second groove track of the pivot pin may limit the pivot pin to move linearly along the longitudinal axis of the pivot pin.

In some implementations, two distal ends of the first groove track of the pivot pin may be close-ended such that, when the tip portion of the second detent pin is received in the first groove track of the pivot pin, the second detent pint prevents removal of the pivot pin from the firearm. The linking groove track of the pivot pin may connect to a middle portion of the first groove track of the pivot pin between the two distal ends of the first groove track such that, when the tip portion of the second detent pin moves from the linking groove track of the pivot pin to the first groove track of the pivot pin, the tip portion of the second detent pin is allowed to move between the two distal ends of the first groove track by linear motions of the pivot pin. The second groove track of the pivot pin may extend between the linking groove track of the pivot pin and the distal end of the pivot pin. A first distal end of the second groove track of the pivot pin may connect with the linking groove track of the pivot pin. A second distal end of the second groove track of the pivot pin opposite the first distal end may be close-ended such that, when the tip portion of the second detent pin is received in the second groove track of the pivot pin, the pivot pin is removable from the firearm by a linear movement of the pivot pin with the tip portion of the second detent pin sliding to the second distal end of the second groove track of the pivot pin.

In some implementations, the shank of the pivot pin may also include a first recess and a second recess. The first recess may be at an intersection between the first groove track and the linking groove track. The second recess may be at an intersection between the second groove track and the linking groove track. The first recess and the second recess may permit the pivot pin to click and stop when the pivot pin is rotated to allow the tip portion of the second detent pin to move in the linking groove track from the first groove track to the second groove track or from the second groove track to the first groove track.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:

a takedown pin configured to hold together a rear portion of a lower receiver of the firearm and a rear portion of an upper receiver of the firearm, the takedown pin comprising:

a head; and a generally cylindrical shank extending from the head toward a distal end of the takedown pin opposite the head, the shank configured with:

a first groove track extending along a longitudinal axis of the shank;

a second groove track parallel to the first groove track and extending along the longitudinal axis of the shank; and a linking groove track extending around the longitudinal axis of the shank and linking the first groove track and the second groove track such that the linking groove track links a distal end of the second groove track to a midpoint between a first distal end of the first groove track and a second distal end of the first groove track opposite the first distal end thereof.

2. The apparatus of claim 1, wherein:

the first groove track, the second groove track and the linking groove track are configured to receive a tip portion of a detent pin of the firearm, when the tip portion of the detent pin is received in the first groove track, the first groove track limits the takedown pin to move linearly along the longitudinal axis of the takedown pin, when the tip portion of the detent pin is received in the linking groove track, the linking groove track limits the takedown pin to rotate partially around the longitudinal axis of the takedown pin to allow the tip portion of the detent pin to move along the linking groove track between the first groove track and the second groove track, and when the tip portion of the detent pin is received in the second groove track, the second groove track limits the takedown pin to move linearly along the longitudinal axis of the takedown pin.

3. The apparatus of claim 2, wherein:

two distal ends of the first groove track are close-ended such that, when the tip portion of the detent pin is received in the first groove track, the detent pin prevents removal of the takedown pin from the firearm, the linking groove track connects to a middle portion of the first groove track between the two distal ends of the first groove track such that, when the tip portion of the detent pin moves from the linking groove track to the first groove track, the tip portion of the detent pin is allowed to move between the two distal ends of the first groove track by linear motions of the takedown pin, the second groove track extends between the linking groove track and the distal end of the takedown pin, a first distal end of the second groove track connects with the linking groove track, and a second distal end of the second groove track opposite the first distal end is open-ended such that, when the tip portion of the detent pin is received in the second groove track, the takedown pin is removable from the firearm by a linear movement of the takedown pin with the tip portion of the detent pin sliding out of the second distal end of the second groove track.

4. The apparatus of claim 3, wherein at least a portion of a bottom surface of the second groove track comprises a slope such that a depth of a first end of the slope toward the first distal end of the second groove track is greater than a depth of a second end of the slope toward the second distal end of the second groove track.

5. The apparatus of claim 3, wherein the shank further comprises:

a first recess at an intersection between the first groove track and the linking groove track; and a second recess at an intersection between the second groove track and the linking groove track, wherein the first recess and the second recess permit the takedown pin to click and stop when the takedown pin is rotated to allow the tip portion of the detent pin to move in the linking groove track from the first groove track to the second groove track or from the second groove track to the first groove track.

6. The apparatus of claim 5, wherein the shank further comprises:

a third recess at one of the two distal ends of the first groove track; and a fourth recess at another of the two distal ends of the first groove track, wherein the third recess and the fourth recess permit the takedown pin to click and stop when the takedown pin is moved linearly to allow the tip portion of the detent pin to move in the first groove track between the two distal ends of the first groove track.

7. The apparatus of claim 1, wherein a circumference of the head of the takedown pin comprises textures, and wherein the textures comprise a plurality of grooves around the circumference, dots, diagonal lines, golf ball patterns, hexagonal patterns, non-smooth patterns, or a combination thereof.

8. An apparatus implementable on a firearm, comprising:

a pivot pin configured to hold together a front portion of a lower receiver of the firearm and a front portion of an upper receiver of the firearm, the pivot pin comprising:

a head; and a generally cylindrical shank extending from the head toward a distal end of the pivot pin opposite the head, the shank configured with:

a first groove track extending along a longitudinal axis of the shank;

a second groove track parallel to the first groove track and extending along the longitudinal axis of the shank; and a linking groove track extending around the longitudinal axis of the shank and linking the first groove track and the second groove track such that the linking groove track links a distal end of the second groove track to a midpoint between a first distal end of the first groove track and a second distal end of the first groove track opposite the first distal end thereof.

9. The apparatus of claim 8, wherein:

the first groove track, the second groove track and the linking groove track are configured to receive a tip portion of a detent pin of the firearm, when the tip portion of the detent pin is received in the first groove track, the first groove track limits the pivot pin to move linearly along the longitudinal axis of the pivot pin, when the tip portion of the detent pin is received in the linking groove track, the linking groove track limits the pivot pin to rotate partially around the longitudinal axis of the pivot pin to allow the tip portion of the detent pin to move along the linking groove track between the first groove track and the second groove track, and when the tip portion of the detent pin is received in the second groove track, the second groove track limits the pivot pin to move linearly along the longitudinal axis of the pivot pin.

10. The apparatus of claim 9, wherein:

two distal ends of the first groove track are close-ended such that, when the tip portion of the detent pin is received in the first groove track, the detent pint prevents removal of the pivot pin from the firearm, the linking groove track connects to a middle portion of the first groove track between the two distal ends of the first groove track such that, when the tip portion of the detent pin moves from the linking groove track to the first groove track, the tip portion of the detent pin is allowed to move between the two distal ends of the first groove track by linear motions of the pivot pin, the second groove track extends between the linking groove track and the distal end of the pivot pin, a first distal end of the second groove track connects with the linking groove track, and a second distal end of the second groove track opposite the first distal end is close-ended such that, when the tip portion of the detent pin is received in the second groove track, the pivot pin is removable from the firearm by a linear movement of the pivot pin with the tip portion of the detent pin sliding to the second distal end of the second groove track.

11. The apparatus of claim 10, wherein the shank further comprises:

a first recess at an intersection between the first groove track and the linking groove track; and a second recess at an intersection between the second groove track and the linking groove track, wherein the first recess and the second recess permit the pivot pin to click and stop when the pivot pin is rotated to allow the tip portion of the detent pin to move in the linking groove track from the first groove track to the second groove track or from the second groove track to the first groove track.

12. The apparatus of claim 11, wherein the shank further comprises:

a third recess at one of the two distal ends of the first groove track; and a fourth recess at another of the two distal ends of the first groove track, wherein the third recess and the fourth recess permit the pivot pin to click and stop when the pivot pin is moved linearly to allow the tip portion of the detent pin to move in the first groove track between the two distal ends of the first groove track.

13. The apparatus of claim 8, wherein a circumference of the head of the pivot pin comprises textures, and wherein the textures comprise a plurality of grooves around the circumference, dots, diagonal lines, golf ball patterns, hexagonal patterns, non-smooth patterns, or a combination thereof.

14. An apparatus implementable on a firearm, comprising:

a takedown pin configured to hold together a rear portion of a lower receiver of the firearm and a rear portion of an upper receiver of the firearm, the takedown pin comprising:

a head; and a generally cylindrical shank extending from the head toward a distal end of the takedown pin opposite the head, the shank configured with:

a first groove track extending along a longitudinal axis of the shank;

a second groove track parallel to the first groove track and extending along the longitudinal axis of the shank; and a linking groove track extending around the longitudinal axis of the shank and linking the first groove track and the second groove track such that the linking groove track links a distal end of the second groove track to a midpoint between a first distal end of the first groove track and a second distal end of the first groove track opposite the first distal end thereof; and a pivot pin configured to hold together a front portion of the lower receiver of the firearm and a front portion of the upper receiver of the firearm, the pivot pin comprising:

a head; and a generally cylindrical shank extending from the head toward a distal end of the pivot pin opposite the head, the shank configured with:

a first groove track extending along a longitudinal axis of the shank;

a second groove track parallel to the first groove track and extending along the longitudinal axis of the shank; and a linking groove track extending around the longitudinal axis of the shank and linking the first groove track and the second groove track such that the linking groove track links a distal end of the second groove track to a midpoint between a first distal end of the first groove track and a second distal end of the first groove track opposite the first distal end thereof.

15. The apparatus of claim 14, wherein:

the first groove track, the second groove track and the linking groove track of the takedown pin are configured to receive a tip portion of a first detent pin of the firearm, when the tip portion of the first detent pin is received in the first groove track of the takedown pin, the first groove track of the takedown pin limits the takedown pin to move linearly along the longitudinal axis of the takedown pin, when the tip portion of the first detent pin is received in the linking groove track of the takedown pin, the linking groove track of the takedown pin limits the takedown pin to rotate partially around the longitudinal axis of the takedown pin to allow the tip portion of the first detent pin to move along the linking groove track between the first groove track and the second groove track, and when the tip portion of the first detent pin is received in the second groove track of the takedown pin, the second groove track of the takedown pin limits the takedown pin to move linearly along the longitudinal axis of the takedown pin.

16. The apparatus of claim 15, wherein:

two distal ends of the first groove track of the takedown pin are close-ended such that, when the tip portion of the first detent pin is received in the first groove track of the takedown pin, the first detent pint prevents removal of the takedown pin from the firearm, the linking groove track of the takedown pin connects to a middle portion of the first groove track of the takedown pin between the two distal ends of the first groove track such that, when the tip portion of the first detent pin moves from the linking groove track to the first groove track, the tip portion of the first detent pin is allowed to move between the two distal ends of the first groove track by linear motions of the takedown pin, the second groove track of the takedown pin extends between the linking groove track of the takedown pin and the distal end of the takedown pin, a first distal end of the second groove track of the takedown pin connects with the linking groove track of the takedown pin, and a second distal end of the second groove track of the takedown pin opposite the first distal end is open-ended such that, when the tip portion of the first detent pin is received in the second groove track of the takedown pin, the takedown pin is removable from the firearm by a linear movement of the takedown pin with the tip portion of the first detent pin sliding out of the second distal end of the second groove track of the takedown pin, wherein at least a portion of a bottom surface of the second groove track of the takedown pin comprises a slope such that a depth of a first end of the slope toward the first distal end of the second groove track of the takedown pin is greater than a depth of a second end of the slope toward the second distal end of the second groove track of the takedown pin.

17. The apparatus of claim 16, wherein the shank of the takedown pin further comprises:

a first recess at an intersection between the first groove track and the linking groove track; and a second recess at an intersection between the second groove track and the linking groove track, wherein the first recess and the second recess permit the takedown pin to click and stop when the takedown pin is rotated to allow the tip portion of the first detent pin to move in the linking groove track from the first groove track to the second groove track or from the second groove track to the first groove track.

18. The apparatus of claim 14, wherein:

the first groove track, the second groove track and the linking groove track of the pivot pin are configured to receive a tip portion of a second detent pin of the firearm, when the tip portion of the second detent pin is received in the first groove track of the pivot pin, the first groove track of the pivot pin limits the pivot pin to move linearly along the longitudinal axis of the pivot pin, when the tip portion of the second detent pin is received in the linking groove track of the pivot pin, the linking groove track of the pivot pin limits the pivot pin to rotate partially around the longitudinal axis of the pivot pin to allow the tip portion of the second detent pin to move along the linking groove track between the first groove track of the pivot pin and the second groove track of the pivot pin, and when the tip portion of the second detent pin is received in the second groove track of the pivot pin, the second groove track of the pivot pin limits the pivot pin to move linearly along the longitudinal axis of the pivot pin.

19. The apparatus of claim 18, wherein:

two distal ends of the first groove track of the pivot pin are close-ended such that, when the tip portion of the second detent pin is received in the first groove track of the pivot pin, the second detent pint prevents removal of the pivot pin from the firearm, the linking groove track of the pivot pin connects to a middle portion of the first groove track of the pivot pin between the two distal ends of the first groove track such that, when the tip portion of the second detent pin moves from the linking groove track of the pivot pin to the first groove track of the pivot pin, the tip portion of the second detent pin is allowed to move between the two distal ends of the first groove track by linear motions of the pivot pin, the second groove track of the pivot pin extends between the linking groove track of the pivot pin and the distal end of the pivot pin, a first distal end of the second groove track of the pivot pin connects with the linking groove track of the pivot pin, and a second distal end of the second groove track of the pivot pin opposite the first distal end is close-ended such that, when the tip portion of the second detent pin is received in the second groove track of the pivot pin, the pivot pin is removable from the firearm by a linear movement of the pivot pin with the tip portion of the second detent pin sliding to the second distal end of the second groove track of the pivot pin.

20. The apparatus of claim 19, wherein the shank of the pivot pin further comprises:

a first recess at an intersection between the first groove track and the linking groove track; and a second recess at an intersection between the second groove track and the linking groove track, wherein the first recess and the second recess permit the pivot pin to click and stop when the pivot pin is rotated to allow the tip portion of the second detent pin to move in the linking groove track from the first groove track to the second groove track or from the second groove track to the first groove track.

* * * * *